US007549622B2

(12) United States Patent
Butikofer

(10) Patent No.: US 7,549,622 B2
(45) Date of Patent: Jun. 23, 2009

(54) DOCUMENT FEEDER AND METHOD OF PREVENTING SKEW IN A DOCUMENT FEEDER

(75) Inventor: Chet Butikofer, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 171 days.

(21) Appl. No.: 11/796,588

(22) Filed: Apr. 27, 2007

(65) Prior Publication Data

US 2008/0265487 A1 Oct. 30, 2008

(51) Int. Cl.
*B65H 5/22* (2006.01)
*B65H 5/00* (2006.01)
*B65H 7/02* (2006.01)

(52) U.S. Cl. ..... 271/3.15; 271/4.02; 271/10.02; 271/25; 271/31; 271/38; 271/110; 271/130; 271/152

(58) Field of Classification Search ..... 271/3.15, 271/4.02, 10.02, 25, 31, 38, 110, 130, 152, 271/153, 154, 155
See application file for complete search history.

(56) References Cited

U.S. PATENT DOCUMENTS

| | | | | |
|---|---|---|---|---|
| 4,888,617 | A * | 12/1989 | Okuzawa | 355/400 |
| 4,892,299 | A | 1/1990 | Hayama | |
| 5,033,731 | A | 7/1991 | Looney | |
| 5,052,673 | A | 10/1991 | Tokuda et al. | |
| 5,076,563 | A * | 12/1991 | Namba et al. | 271/10.09 |
| 5,273,271 | A | 12/1993 | Intemann | |
| 5,405,129 | A | 4/1995 | Mihara et al. | |
| 5,700,003 | A | 12/1997 | Sung | |
| 6,457,707 | B1 | 10/2002 | Hendrix et al. | |
| 6,824,133 | B2 | 11/2004 | Richtsmeier | |
| 6,986,509 | B2 | 1/2006 | Koh et al. | |
| 7,139,108 | B2 | 11/2006 | Andersen et al. | |
| 7,431,286 | B2 * | 10/2008 | Powell et al. | 271/148 |
| 2005/0173859 | A1 | 8/2005 | Koh et al. | |

* cited by examiner

*Primary Examiner*—David H Bollinger

(57) ABSTRACT

A document feeder includes a tray for holding one or more document sheets and a first flag disposed adjacent to the tray so as to engage a document sheet in the tray. A second flag is disposed adjacent to the tray to engage the document sheet so that the first and second flags produce balanced amounts of friction on the document sheet.

15 Claims, 2 Drawing Sheets

DOCUMENT FEEDER AND METHOD OF PREVENTING SKEW IN A DOCUMENT FEEDER

BACKGROUND OF THE INVENTION

Automated business machines for producing or reproducing hard copy documents, such as copiers, printers, facsimile machines, multi-function devices (MFD), and the like, often employ a scanning apparatus for scanning documents. Typically, a scanning apparatus will provide both manual document feed and automatic document feed capabilities. An automatic document feeder (ADF) is commonly used for automatically loading and unloading single sheets sequentially to a scanning station where the apparatus scans the fed document sheets for copying, faxing, displaying on a computer monitor, or the like. Following the operation, the ADF then off-loads a sheet and feeds the next sheet of the document to the scanning station.

Automatic document feeders often include a paper presence sensor that can detect whether or not a document is present in the input tray of the ADF. One common paper presence sensor employs a flag in conjunction with an optical sensor. When there is no paper loaded in the input tray of the ADF, the flag blocks the optical sensor; when paper is loaded in the input tray of the ADF, the flag is pushed out of view of the optical sensor. The controller of the scanning apparatus thus knows that paper is present when the optical sensor is not being blocked and paper is not present when the optical sensor is being blocked. When the start button of the scanning apparatus is pressed, the ADF will be activated if paper is present, but the ADF will not be activated if paper is not present.

The paper present flag drags on each sheet of the document as it is being fed into the ADF and thus produces friction. Because paper present flags are typically located off center with respect to the document sheet, the friction from the flag is off-centered and thus causes one side of the sheet to slow down with respect to the other side of the sheet. This causes skewing of the sheet (i.e., the sheet enters the ADF paper path at an angle). Skewing results in faulty scanning of the sheet.

One approach to preventing skewing is to include de-skew or registration rollers inside the ADF paper path. As a sheet is being feed into the ADF paper path, it contacts the de-skew rollers, which cause the sheet to buckle slightly so that the leading edge of the sheet lines up with the rollers before being advanced. However, this approach adds significantly to the cost of the apparatus as the additional rollers, plus a motor for the rollers, must be provided.

Another approach to preventing skewing is the provision of a skew correcting algorithm that adjusts for skewing. However, such algorithms tend to be very complex and many scanning apparatus that have ADFs do not employ enough computing power to digitally de-skew documents.

DETAILED DESCRIPTION OF THE INVENTION

Figure 1:
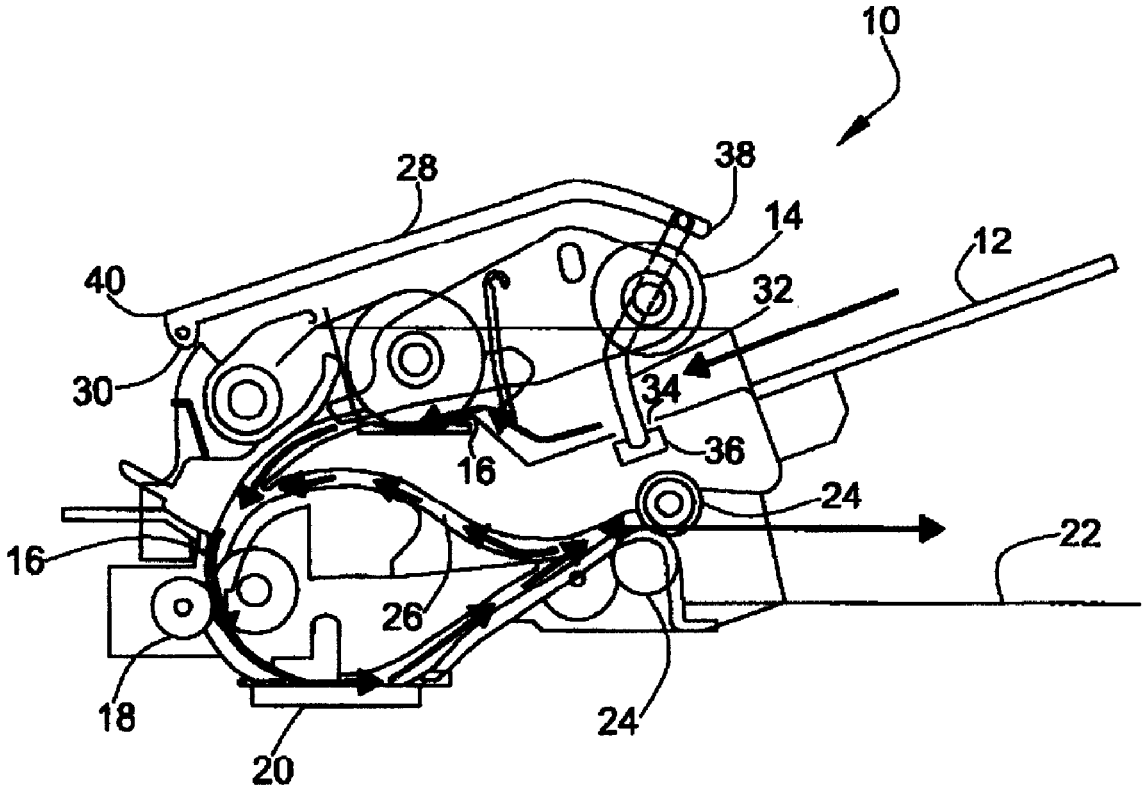
FIG. 1 is a cross-section view of an automatic document feeder (ADF).

Referring to the drawings wherein identical reference numerals denote the same elements throughout the various views, FIG. 1 shows an exemplary automatic document feeder (ADF) 10 that can be used in conjunction with a scanning apparatus. The ADF 10 includes an input tray 12 for holding a stack of document sheets to be scanned. One or more pick rollers 14 are disposed over the input tray 12. When a user initiates a scanning operation, the pick rollers 14 engage the top document sheet in the input tray 12 and feed that sheet into a primary paper path 16 of the ADF 10. A series of additional rollers 18 advance the sheet along the paper path 16 (as shown by the arrows) to a glass surface 20 defining a scanning station where the sheet is scanned.

After scanning, the sheet can either be directed to an output tray 22 by post-scan rollers 24, or the post-scan rollers 24 can direct the sheet along a secondary paper path 26, which feeds the sheet back to the glass surface 20 but with the opposite side of the sheet exposed for scanning. This provides for two-sided scanning.

The ADF 10 further includes an access cover 28 disposed over the various rollers. The access cover 28 is pivotally mounted to the housing (not shown) of the ADF 10 by hinges 30 (one shown in FIG. 1) so that the cover 28 can be opened to provide internal access to the ADF 10. A paper present flag 32 is located to one side of the pick rollers 14 (which are generally centered with respect to the paper path 16) to assist in detecting whether or not document sheets are present in the input tray 12. The paper present flag 32 is pivotally mounted to the underside of the access cover 28 and extends downward toward the input tray 12. A slot 34 is formed in the input tray 12 directly below the paper present flag 32. An optical sensor 36 is located underneath the input tray 12 and adjacent to the slot 34.

The optical sensor 36 includes a light emitter and a light detector positioned relative to one another so that the light emitter emits a beam of light that impinges on the light detector. If there are one or more document sheets in the input tray 12, the sheets will cover the slot 34 and the paper present flag 32 will not extend through the slot 34. In this case, the light detector will continue to receive light from the light emitter and the optical sensor 36 will provide an indication that documents are present in the input tray 12. If there are no document sheets in the input tray 12, the slot 34 will be clear and the paper present flag 32 will extend through the slot 34. When the paper present flag 32 extends through the slot 34, it falls between the light emitter and the light detector to block the beam of light. When the light beam is blocked, the optical sensor 36 will provide an indication that there are no document sheets in the input tray 12.

Figure 2:
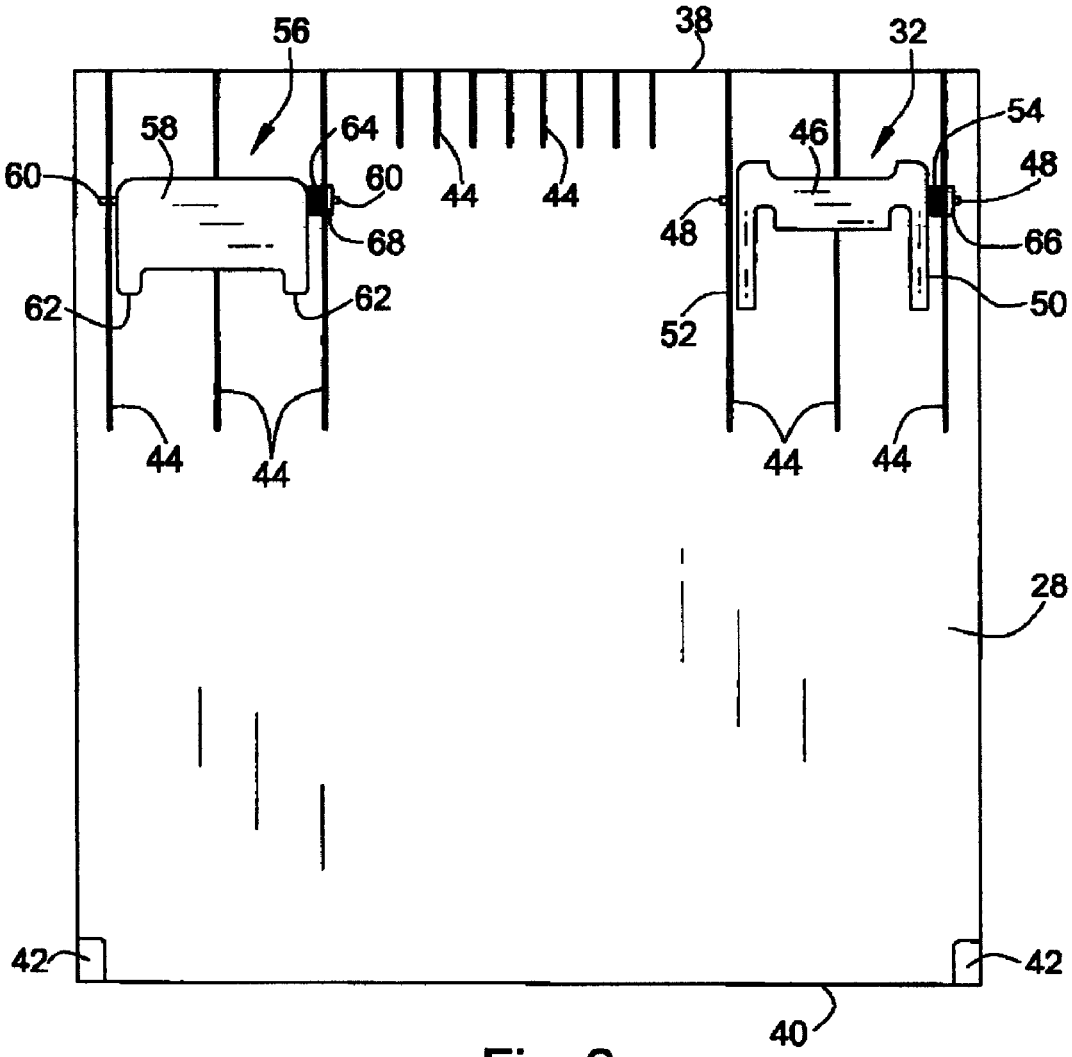
FIG. 2 is a plan view of the underside of an access cover from the ADF of FIG. 1.

Referring to FIG. 2, the underside of the access cover 28 is shown. The access cover 28 has a front edge 38, which overlies the input tray 12, and a back edge 40. Tabs 42, which define a portion of the hinges 30, are formed on the underside of the access cover 28, along the back edge 40. Also formed on the underside of the access cover 28 is a series of ribs 44 that restrain document sheets vertically and guide a sheet as it is being fed from the input tray 12 into the primary paper path 16.

Figure 3:
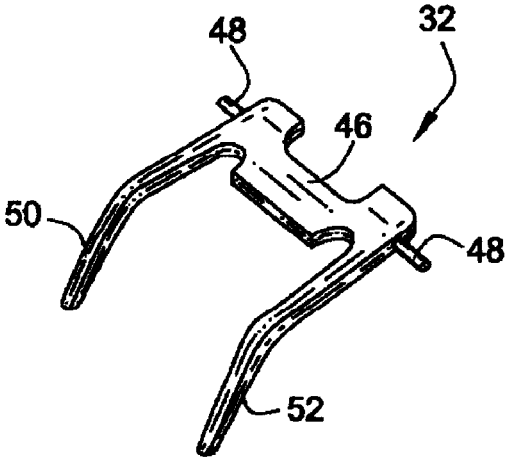
FIG. 3 is a perspective view of a paper present flag used in the ADF of FIG. 1.

In the illustrated embodiment, the paper present flag 32 is located on the right side of the access cover 28 and near the front edge 38 so as to be located adjacent to the input tray 12 when the cover 28 is closed. The paper present flag 32 (also shown in FIG. 3) comprises a generally rectangular body member 46 having two axles 48 extending laterally outward from opposing sides thereof. The axles 48 are received in openings formed in the first and third ribs 44 from the right, respectively, to pivotally mount the paper present flag 32 to the cover 28. The paper present flag 32 further includes two arms 50, 52 formed on the two sides of the body member 46 and extending downward therefrom. The two arms 50, 52 are arranged to extend through the slot 34 when no document sheets are in the input tray 12. When document sheets are present in the input tray 12, the distal ends of the arms 50, 52 engage the topmost sheet. Note that the slot 34 can be wide enough to receive both of the laterally spaced apart arms 50, 52, or two slots can be provided: one to receive the right arm 50 and one to receive the left arm 52. The left arm 52 does not interact with the optical sensor 36, but is provided to engage narrower document sheets. In other words, when the document being scanned is printed a narrow type of paper, such as A4 paper, the sheets might be too narrow to block the right arm 50. However, the left arm 52, by virtue of being closer to the center will still engage the document sheets in the input tray 12 and thus prevent either arm 50, 52 from extending through the slot 34.

A coiled torsion spring 54 is mounted over the right axle 48 between the paper present flag 32 and the first rib 44 from the right. The torsion spring 54 is arranged to apply a spring force between the rib 44 and the paper present flag 32 that biases the paper present flag 32 to rotate about the axles 48 in a direction that forces the arms 50, 52 toward the input tray 12. Alternatively, the torsion spring 54 could be omitted and gravity relied upon to force the paper present flag 32 downward.

Figure 4:
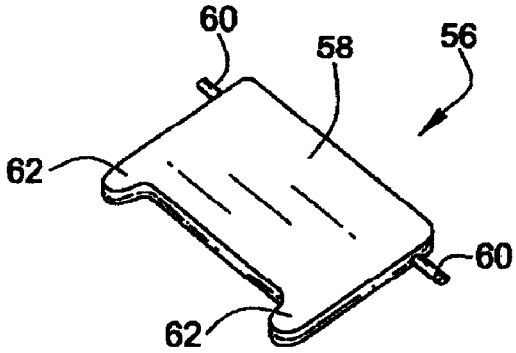
FIG. 4 is a perspective view of a second flag used in the ADF of FIG. 1.

A second flag 56 is mounted to the underside of the access cover 28 on the left side thereof and near the front edge 38 so as to be located adjacent to the input tray 12 when the cover 28 is closed. The second flag 56 (also shown in FIG. 4) comprises a generally rectangular body member 58 having two axles 60 extending laterally outward from opposing sides thereof. The axles 60 are received in openings formed in the first and third ribs 44 from the left, respectively, to pivotally mount the second flag 56 to the cover 28. The second flag 56 further includes two spaced-apart tabs 62 extending outward from a forward edge thereof. The tabs 62 do not extend through the input tray 12 and thus do not need to be as long as the arms 50, 52. However, the tabs 62 are preferably sized to produce a sheet contact area that is the same as, or similar to, the sheet contact area defined by the arms 50, 52.

A coiled torsion spring 64 is mounted over the right axle 60 between the second flag 56 and the third rib 44 from the left. The torsion spring 64 is arranged to apply a spring force between the rib 44 and the second flag 56 that biases the second flag 56 to rotate about the axles 60 in a direction that forces the tabs 62 toward the input tray 12 so that the tabs 62 engage the topmost document sheet. The two torsion springs 54, 64 preferably provide substantially equal spring forces. The torsion spring 64 can alternatively be omitted if the paper present flag 32 lacks a torsion spring.

While the two torsion springs 54, 64 preferably provide substantially equal spring forces, it possible that variances in the spring forces can develop due to manufacturing tolerances, fatigue, etc. Such spring force variance could result in an undesirable friction mismatch between the two flags 32, 56. To overcome spring force variances, a means or mechanism for adjusting the spring force of one or both of the torsion springs 54, 64 is provided. In the illustrated embodiment, a first dial 66 is coupled to the first torsion spring 54 and a second dial 68 is coupled to the second torsion spring 64. When a user rotates the first dial 66 in a first direction, the first torsion spring 54 is wound tighter, thereby increasing the torsional spring force. Increased spring force would cause the paper present flag to apply more pressure to the document in the input tray 12. When the first dial 66 is rotated in the other direction, the first torsion spring 54 is unwound, thereby decreasing the torsional spring force. The second dial 68 similarly controls the torsional spring force of the second torsion spring 64. The dials 66, 68 thus allow users to make slight adjustments to the torsion spring strength to optimize how document sheets are fed into the paper path 16. The dials 66, 68 could be provided with detents at specified locations indicated by a number scale. While a dial is shown in FIG. 2 for both torsion springs 54, 64, an alternative approach would be to provide only one dial for one or the other of the springs.

In operation, a user inserts a document to be scanned into the input tray 12. This causes the arms 50, 52 of the paper present flag 32 to be pushed up and out of the optical sensor 36. The arms 50, 52 and the tabs 62 of the second flag 56 all engage the topmost sheet of the document. (If the document is printed on a narrow type of paper, such as A4 paper, then only the left arm 52 and innermost tab 62 engage the topmost sheet of the document.) The user then initiates a scanning operation, typically by pressing a start button. The optical sensor 36 detects the presence of the document in the input tray 12, and the pick roller or rollers 14 engage the top document sheet and feed that sheet into a primary paper path 16. As the sheet is being fed into the paper path 16, the arms 50, 52 and the tabs 62 drag across the sheet and produce friction. However, because the paper present flag 32 and the second flag 56 are located on opposite sides of, and substantially equidistant from, the centerline of the moving sheet, the two flags 32, 56 produce balanced amounts of friction on the moving document sheet. Because the left and right sides of the sheet experience the same amount of friction, the sheet does not skew as it enters the primary paper path 16.

Should the user notice skewing of the scanned documents, then he or she could adjust the spring force of one or both of the torsion springs 54, 64 to eliminate the skewing. For example, say the ADF 10 is skewing documents to the right, which would suggest that the paper present flag 32 (the flag located to the right of the document centerline) is producing more friction than the second flag 56. To correct this, the user would open the access cover 28 and turn the second dial 68 so that the second torsion spring 64 applies a greater force to the second flag 56, which in turn would produce more friction to balance the friction from the paper present flag 32. (Alternatively, the user could turn the first dial 66 so that the first torsion spring 54 applies a smaller force to the paper present flag 32.) The user can then feed another document sheet through the ADF 10 to see if the skewing has been corrected. If not, the user could make further spring adjustments until skew is eliminated.

The second flag 56 does not assist in paper sensing function but balances the friction on the top document sheet as it is being fed into the paper path 16. The second flag 56 is thus sized, and the spring force of the torsion spring 64 is set, so that the friction produced by the tabs 62 is equal to the friction produced by the arms 50, 52 of the paper present flag 32. In addition, because the second flag 56 is aligned with the three leftmost ribs 44, it also serves to prevent the document sheets from climbing up on the inside of the leftmost rib 44, which typically lines up with the edge of letter-sized paper sheets. This can be a particular problem when document sheets have "dog-eared" or bent corners which are susceptible to climbing up on the inside of the rib and then creating paper jams. The second flag 56 will help prevent the left side of the sheets from climbing up on the inside of the leftmost rib 44. The second flag 56 will also help protect document sheets from the other ribs 44. For example, some narrow media may catch the second rib from the left. Similarly, the paper present flag 32 will function to prevent the right side of document sheets from catching any of the ribs 44 on the right side of the cover 28.

The paper sensing flag 32 represents just one approach to sensing the presence of paper; many other paper sensing techniques are possible. The two flags 32, 56 could still be used in ADFs that use a different manner of paper sensing to keep document sheets from skewing and to keep dog eared and other problematic document sheets from catching on the ceiling of the paper path. These flags can be helpful even when there are no ribs hanging from the paper path ceiling because the flags help "funnel" document sheets into the paper path without curling up or catching on the ceiling area of the paper path.

While specific embodiments of the present invention have been described, it should be noted that various modifications thereto can be made without departing from the spirit and scope of the invention as defined in the appended claims.

What is claimed is:

1. A document feeder comprising:

a tray for holding one or more document sheets;

a first flag disposed adjacent to said tray so as to engage a document sheet in said tray and produce friction on said document sheet as said document sheet is fed through said document feeder;

a second flag disposed adjacent to said tray so as to engage said document sheet and produce friction on said document sheet as said document sheet is fed through said document feeder, wherein said first and second flags produce balanced amounts of friction on said document sheet as said document sheet is fed through said document feeder; and a cover having an underside, and wherein said first flag is pivotally mounted to said underside on one side of said cover and said second flag is pivotally mounted to said underside on another side of said cover.

2. The document feeder of claim 1 further comprising a first spring for biasing said first flag towards said tray, and a second spring for biasing said first flag towards said tray.

3. The document feeder of claim 2 further comprising means for adjusting the spring force of said first spring.

4. The document feeder of claim 3 further comprising means for adjusting the spring force of said second spring.

5. The document feeder of claim 1 further comprising a slot formed in said tray and an optical sensor located adjacent to said slot, wherein said first flag is positioned to extend through said slot and block said optical sensor if no document sheets are in said tray.

6. The document feeder of claim 1 wherein said document defines a centerline and said first flag is located on one side of said centerline and said second flag is located on another side of said centerline.

7. The document feeder of claim 6 wherein said first flag and said second flag are located equidistant from said centerline.

8. A document feeder comprising:

a tray for holding one or more document sheets;

a first flag disposed adjacent to said tray so as to engage a document sheet in said tray and produce friction on said document sheet as said document sheet is fed through said document feeder; and a second flag disposed adjacent to said tray so as to engage said document sheet and produce friction on said document sheet as said document sheet is fed through said document feeder, wherein said first and second flags produce balanced amounts of friction on said document sheet as said document sheet is fed through said document feeder, wherein said first flag has two arms that engage said document sheet and said second flag has two tabs that engage said document sheet.

9. The document feeder of claim 8 wherein said two arms and said two tabs define equal sheet contact areas.

10. A method of preventing skew in a document feeder having a tray for holding one or more document sheets and a paper present flag for detecting a presence of document sheets in said tray, said paper present flag engaging a topmost document sheet in said tray and producing friction on said topmost document sheet as said topmost document sheet is fed through said document feeder, said method comprising providing a second flag that balances the friction produced by said paper present flag on said topmost document sheet in said tray as said topmost document sheet is fed through said document feeder, said method further comprising providing a spring force for biasing said second flag towards said tray, and setting the spring force on said second flag to be equal to a spring force acting on said paper present flag.

11. The method of claim 10 further comprising placing said second flag on an opposite side of a centerline defined by said topmost document sheet from said paper present flag.

12. The method of claim 11 further comprising placing said second flag an equal distance from said center line as said paper present flag.

13. The method of claim 10 further comprising adjusting the spring force on said second flag.

14. The method of claim 10 further comprising adjusting said spring force acting on said paper present flag.

15. The method of claim 10 further comprising providing said second flag with a sheet contact area that is equal to a sheet contact area of said paper present flag.

* * * * *